US005428873A

United States Patent [19]

Hitchcock et al.

[11] Patent Number: 5,428,873

[45] Date of Patent: Jul. 4, 1995

[54] BALL LATCH MECHANISM

[75] Inventors: Mel L. Hitchcock, Costa Mesa; Coleman W. Conrad, Whitter; Charles H. Pearson, Riverside, all of Calif.

[73] Assignee: BW/IP International, Inc., Long Beach, Calif.

[21] Appl. No.: 54,618

[22] Filed: Apr. 29, 1993

[51] Int. Cl.[6] ..... A44B 1/04

[52] U.S. Cl. ..... 24/303; 24/607; 70/386

[58] Field of Search ..... 24/606, 607, 303; 70/386; 292/252; 411/348

[56] References Cited

U.S. PATENT DOCUMENTS

| | | | |
|---|---|---|---|
| 913,942 | 3/1909 | Bodge . | |
| 2,121,301 | 6/1938 | Ractliffe . | |
| 2,177,996 | 10/1939 | Raymond . | |
| 2,480,662 | 8/1949 | McKinzie | 24/607 X |
| 3,430,305 | 3/1969 | Geffner | 24/607 X |
| 4,290,285 | 9/1981 | Bela et al. . | |
| 4,507,034 | 3/1985 | Lew et al. | 24/607 X |
| 4,523,356 | 6/1985 | Charlot, Jr. . | |
| 4,815,304 | 3/1989 | Kesselman . | |
| 4,848,110 | 7/1989 | Kuo . | |
| 4,901,544 | 2/1990 | Jang . | |
| 4,946,130 | 8/1990 | Kooiman | 70/386 X |
| 5,040,652 | 8/1991 | Fish et al. . | |
| 5,052,205 | 10/1991 | Poli . | |
| 5,061,112 | 10/1991 | Monford, Jr. . | |
| 5,077,872 | 1/1992 | Guthammar . | |

FOREIGN PATENT DOCUMENTS

| | | | |
|---|---|---|---|
| 881088 | 11/1961 | United Kingdom | 24/607 |

*Primary Examiner*—Laurie K. Cranmer
*Attorney, Agent, or Firm*—Pretty, Schroeder, Brueggemann & Clark

[57] ABSTRACT

A ball latch mechanism including an annular cage concentrically located between a bearing member and a trigger. The cage includes a slot and a latch ball located in the slot in contacting relation with the trigger. The latch ball is radially movable between a first position in which the ball protrudes from the slot to interfere with movement of the bearing member and a second position wherein the ball is retracted into the trigger. Each slot is circumferentially elongated in relation to the ball such that, upon rotation of the trigger from a latch position to an unlatched position, the ball rolls circumferentially along the cylindrical surface within the slot. A biasing means may be used to urge the ball toward a preferred starting location.

16 Claims, 2 Drawing Sheets

BALL LATCH MECHANISM

This invention relates generally to ball latch mechanisms and, in particular, to a magnetically biased ball latch mechanism having a highly loaded impact member that is released upon unlatching.

BACKGROUND OF THE INVENTION

Ball latch mechanisms are typically used for releasably engaging one member to another. Such mechanisms typically include an outer tubular member, an inner cylindrical member and a cage member concentrically located between the outer and inner member, the cage member having a plurality of circumferentially arranged apertures for receiving spherical balls. A cylindrical inner wall of the tubular member has grooves that may be aligned with the apertures of the cage member for receiving the spherical balls. Similarly, an outer wall of the cylindrical member has notches for receiving the spherical balls. In a latched condition, the balls are simultaneously disposed in the apertures of the cage member and the grooves of the outer tubular member, preventing any relative axial movement between the two. To unlatch the tubular member from the cage member, the inner cylinder member is moved, either rotationally or axially, relative to the cage member such that the notches of the cylindrical member are aligned with the balls. In this position, the balls are permitted to retract radially below the outer surface of the cage member into the notches and the tubular member is free to move axially past the balls.

In some situations, it may be desirable to apply a large axial load to the outer tubular member in the latched condition which, upon unlatching, causes an immediate and powerful axial movement of the outer tubular member with respect to the cage member. One application for such a device would be a preloaded impact member that is used to strike an object with a high impact force. In such a case, the inner tubular member would act as a trigger for releasing the impact member. A difficulty encountered in this application, however, is that the axial load applied to the impact member in the latched condition would be transferred through the spherical balls to the cylindrical member. Thus, a relatively high force would be required to overcome the high frictional forces between the spherical balls and the outer wall of the cylindrical member in order to align the notches of the cylindrical member with the balls, releasing the impact member.

It will be appreciated that a disadvantage of the ball latch mechanism mentioned above, especially in the context of a trigger mechanism, is that a larger, more powerful, device is required to reliably effect the necessary movement of the cylindrical member to move the balls to the unlatched position. Accordingly, there is a need for a ball latch mechanism that effects movement of the trigger using only a relatively low force, yet is nevertheless adequate to latch and unlatch a highly loaded impact member. The present invention satisfies this need.

SUMMARY OF THE INVENTION

The present invention is embodied in a ball latch mechanism having a specially designed cage that permits the force necessary to unlatch the mechanism to be greatly reduced. Such a ball latch mechanism includes a bearing member having a longitudinal axis and a bearing surface, a trigger having a cylindrical surface that is concentric to the bearing member and an annular cage concentrically located between the bearing member and the trigger. The cage defines a slot for receiving a latch ball and the cylindrical surface of the trigger defines a notch for selectively receiving the latch ball. The bearing member and the cage are axially movable with respect to each other and the trigger may be rotated relative to the cage. The cage is further disposed such that upon rotation of the trigger with respect to the cage, the cage slot and the trigger notch can be aligned. In the unaligned condition, the latch ball is outside the notch of the trigger and locked against the bearing surface of the load member. In the aligned condition, the latch ball retracts radially into the notch of the trigger below the outer wall of the cage member, permitting the load member to be moved axially relative to the cage.

A feature of the present invention is the use of circumferentially elongated slots in the cage for receiving the latch balls. Such a slot configuration will permit the balls to roll during rotation of the trigger resulting in a low rolling friction rather than a higher sliding or skidding friction.

Another feature of the present invention is the use of a magnetic flux field, or other biasing arrangement, to attract the latch balls to a repeatable and predictable "start" position within the cage slots, prior to the application of a load to the bearing member and movement into a latched position. Without the biasing arrangement, the precise location of the balls in the slots is uncertain and may be particularly problematical if external forces, such as gravity, acceleration or environmental vibration are applied in an adverse manner to the device. The predictable and repeatable positioning of the latch ball within the cage slots is critical to repeatable and predictable friction and load release characteristics of a highly loaded latch mechanism.

A further feature of the invention is the use of two or more latch balls in tandem alignment within the cage slot. This arrangement provides a more consistent and lower torque value requirement for rotation of the trigger. Further, configuring the cage slots to accommodate the tandem balls will also result in other desirable attributes, such as stability of the latched position.

Because of the specially configured slots and the use of a biasing arrangement to place the balls in a preferred start location, rotation of the trigger will cause the balls to roll relatively freely as they translate from one side of the cage slot (the initial load position), to the opposite side of the slot. As a result of this low friction rolling translation of the latch balls, the trigger may easily be rotated to the position that allows the balls to retract down into the notches. This allows the balls to withdraw from the locked "protrusion" position above the surface of the cage, and to allow the bearing member to pass freely, "unlocking" the load.

Other features and advantages of the present invention will become apparent from the following description of the preferred embodiment, taken in conjunction with the accompanying drawings, which illustrate, by way of example, the principles of the invention.

DETAILED DESCRIPTION OF THE PREFERRED EMBODIMENT

Figure 1A:
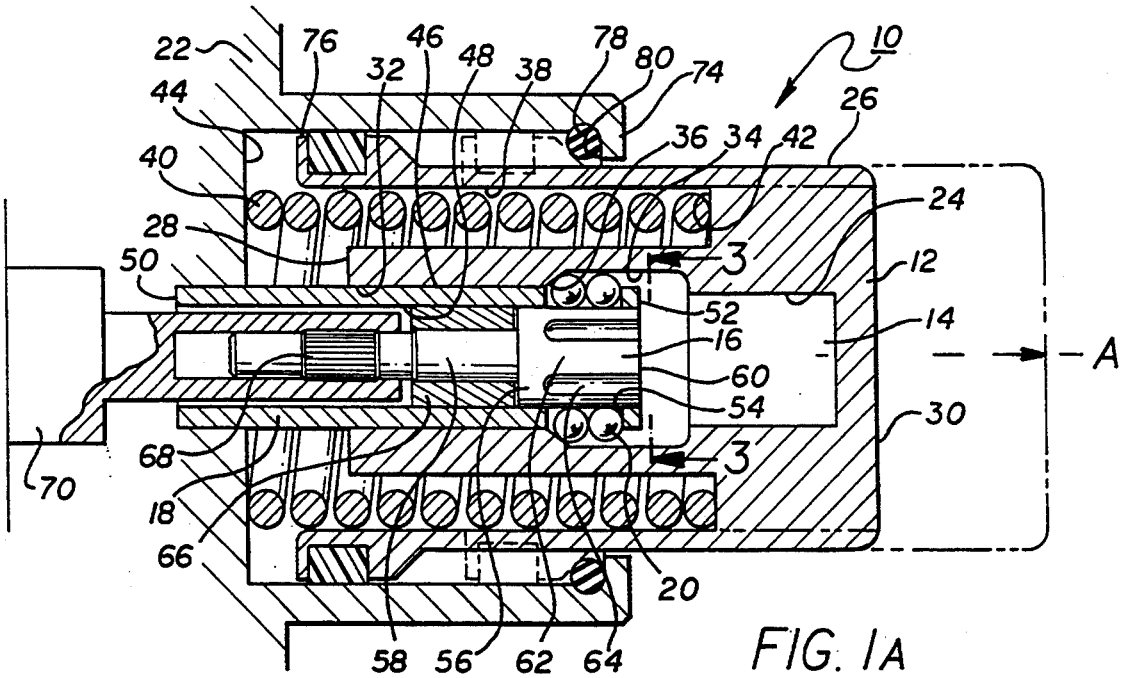
FIGS. 1A and 1B are sectional views of a ball latch mechanism according to the present invention, shown in the latched and unlatched positions, respectively.

A ball latch mechanism 10 embodying the features of the present invention is shown in a latched position in FIG. 1A. The mechanism includes a bearing member 12 defining a longitudinally extending central bore 14 having a longitudinal axis A. A trigger 16 for unlatching the bearing member is concentrically disposed within the bore. A cage 18 that holds a plurality of latch balls 20 is concentrically located between the bearing member and the trigger. The cage is mounted to a suitable support frame 22. In the preferred embodiment, the bearing member is spring loaded and when unlatched will shoot forward from left to right along the outside of the cage to the unlatched position as shown in phantom in FIG. 1A and in solid lines in FIG. 1B.

The bearing member 12 has an inner wall 24 defining the bore 14, an outer cylindrical wall 26, a rear surface 28 and a front surface 30. The inner wall includes a first cylindrical surface 32 and a second cylindrical surface 34 separated by a frustoconical bearing surface 36. The first cylindrical surface has a diameter that permits sliding engagement between the bearing member and the cage. The second cylindrical surface has a diameter greater than the first cylindrical surface. An annular bore 38 extends axially into the rear surface of the bearing member between its inner and outer walls 24, 26. A coil spring 40 is located in the annular bore and is biased between a front end 42 of the annular bore and an inner wall 44 of the support frame to impart an axial load L on the bearing member. It will be appreciated by those skilled in the art that the exterior shape of the bearing member as well as the spring arrangement or other loading arrangement on the bearing member may be varied depending on the particular application.

The cage 18 is tubular in shape having an outer cylindrical wall 46, an inner cylindrical wall 48, a rear end 50 and a front end 52. The cage is rigidly supported at its rear end 50 by the frame 22 with the bearing member slidably mounted on the cage, permitting relative axial movement between the two.

The cage defines a plurality of circumferentially arranged slots 54 adjacent its front end 52. In the preferred embodiment, the cage member has four slots disposed 90 degrees apart, each slot configured to retain two suitably sized latch balls 20 in tandem alignment, i.e., the balls are disposed substantially in-line with the load L applied on the bearing member by the coil spring 40 (see also FIG. 2). The latch balls are preferably made of chrome steel, tungsten carbide, or any other suitable material that provides a smooth, hard, wear-resistant, and magnetic surface.

Figure 1B:
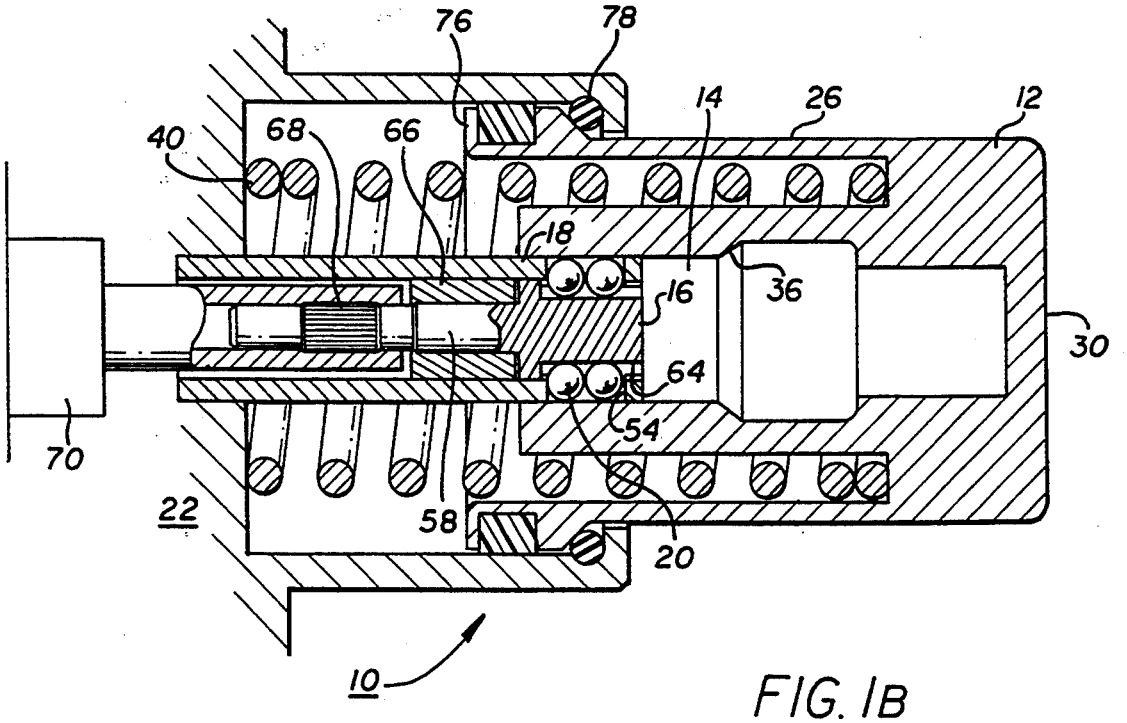
Figure 3:
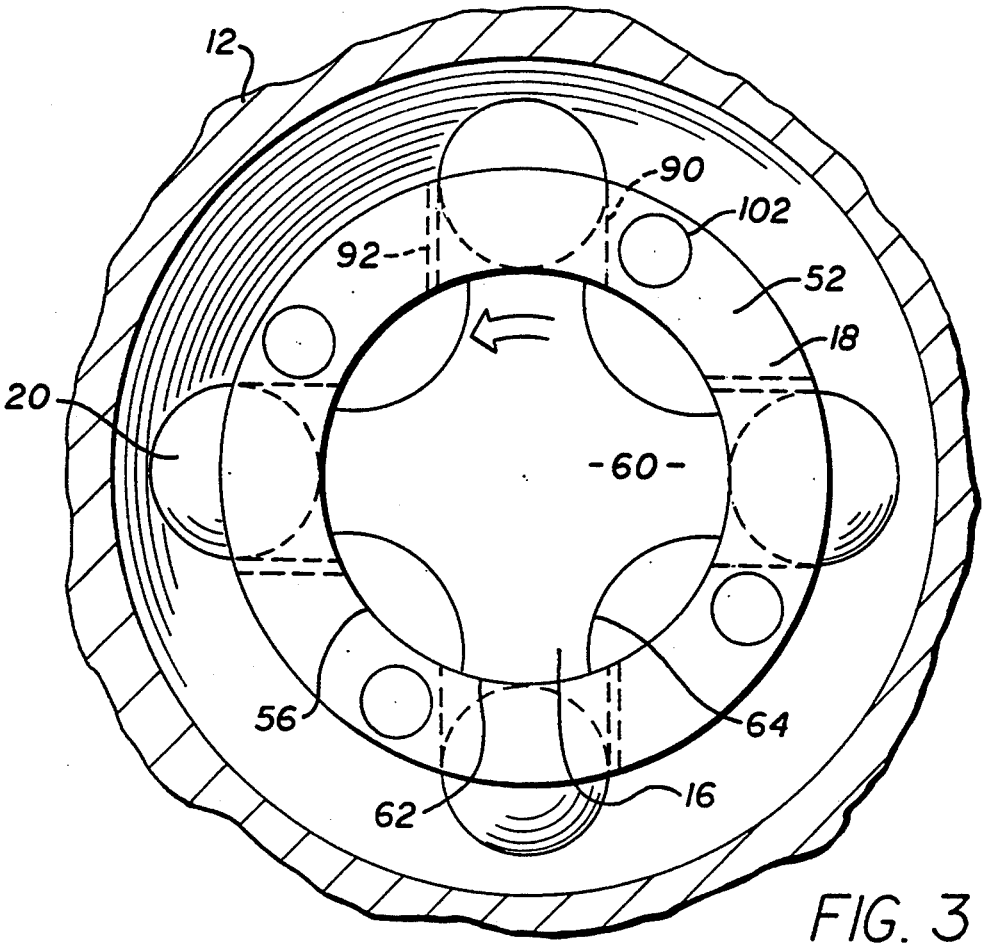
FIG. 3 is a sectional view taken along line 3—3 of FIG. 1A.

With reference now also to FIG. 3, the trigger 16 includes a first cylindrical portion 56, a second cylindrical portion 58 and a front end 60. The first cylindrical portion 56 has an outer surface 62 that defines four notches, preferably in the shape of fluted channels 64, that extend axially inward from the front end of the trigger. The channels are circumferentially spaced 90 degrees apart and have a semi-circular configuration for receiving the latch balls. The trigger is arranged inside the cage such that, upon rotation of the trigger, the fluted channels 64 may be aligned with the slots 54 of the cage, wherein the latch balls may be retracted radially into the channels (FIG. 1B).

The second cylindrical portion 58 of the trigger may be centered within the cage by a bearing 66 and may be provided with a spline 68 so as to be mounted to a rotating device, such as a rotary solenoid 70. The rotating device itself may be mounted to the frame 22. Many types of rotary solenoids and other devices for rotating a cylindrical member are known to those skilled in the art and need not, therefore, be described in detail herein. Alternatively, the trigger may be manually turned.

In order to place the mechanism in the latched position, the bearing member 12 is forced axially to the left against the force of the coil spring 40 until the frustoconical bearing surface 36 of the bearing member is positioned over the cage slots 54 (FIG. 1A). The trigger 16 is then rotated by the rotary solenoid 70 until the channels 64 of the trigger and the cage slots are out of alignment, forcing the latch balls 20, by cam action, radially outward and into contact with the frustoconical bearing surface, locking the bearing member in the latched or locked position (see also FIG. 3). In this position, the bearing member is prevented from moving to the right due to the interference caused by the latch balls protruding through the cage and engaging the inclined plane formed by the frustoconical surface. Unlatching occurs by further rotation of the trigger to align the channels of the trigger and the cage slots. In this latter position, the force on the bearing member will cause the latch balls to retract radially below the outer wall 46 of the cage into the channels, releasing the bearing member (FIG. 1B).

It will be appreciated that a variety of other configurations may be used as a bearing surface on the bearing member, other than the frustoconical bearing surface 36. For example, the inner wall of the bearing member may simply be provided with a circumferential groove or a plurality of circumferentially spaced notches.

Figure 2:
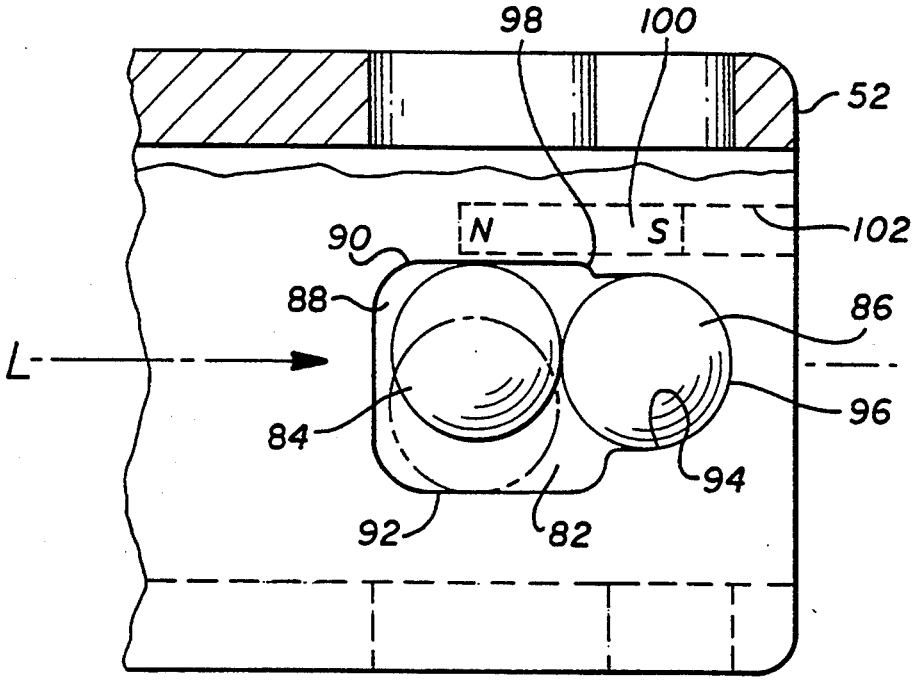
FIG. 2 is a plan view of the cage of the mechanism shown in FIG. 1A.

In the case of a highly loaded bearing member, it is desirable that the cage slots have a configuration that permits at least one of the latch balls to roll during rotation of the trigger from the latched (loaded) position to the unlatched position. A preferred slot configuration is shown in FIG. 2 wherein a slot 82 is shown retaining a first ball 84 and a second ball 86 in a tandem alignment, i.e., in alignment with the axial component of the load L transmitted from the coil spring through the bearing member to the first and second balls.

The slot 82 has a first portion 88 that is circumferentially elongated to ensure rolling of the first ball 84 during the first ball's translation to the unlatched position. For example, counterclockwise rotation of the trigger 60 to the unlatched position (as viewed in FIG. 3) will cause the first ball to roll circumferentially from a first position (shown in solid line in FIG. 2) adjacent a first axially extending side edge 90 that partially defines the upper edge of the slot to a second position (shown in dashed line in FIG. 2) adjacent a second axially extending side edge 92 that partially defines the lower edge of the slot.

The slot further has a second portion 94 that is preferably defined by a semi-circular edge 96 for securely retaining the second ball 86. In the preferred embodiment, the second ball provides a desirable low friction and highly wear resistant bearing surface from which to support the translating first ball during the unlatching cycle of motion.

The cage slots may be further modified to accommodate a ball latch mechanism using only a single ball per slot or, alternatively, several balls per slot, depending on the particular application. Also, the first axially-extending side edge 90 of the slot may be slightly offset, for example, at edge 98, from the semi-circular edge 96 of the slot such that, in the latched position, the first ball is located past top dead center of the second ball (i.e., toward and against the first axially-extending side edge), providing a positive latch and a natural at-rest position against the load L acting on the bearing member.

In the preferred embodiment, the latch balls are biased toward a preferred start location by placing a permanent magnet 100 adjacent each first axially-extending side edge 90 of the slot. The magnets may be inserted through holes 102 bored axially into the front end 52 of the cage. Preferably, each magnet has a long, cylindrical shape and is arranged in the bore with one pole over each ball. Such an arrangement must be suitable to create a magnetic flux field to attract the latch balls to a repeatable and predictable position against the first axially-extending side edges 90 in the cage slots. The magnets thus ensure that the latch balls will be in the position that is most desired regardless of the external forces acting on the mechanism or the orientation of the mechanism relative to the normal force of gravity. When using such a magnetic biasing device, the cage should be made of a non-magnetic material, such as stainless steel, so as not to interfere with the magnetic field created.

In one application, wherein the bearing member is a highly loaded impact member intended to be used to strike an object with a high-impact force, the ball latch mechanism may be initially latched by manually moving the impact member against the force of the coil spring until the frustoconical surface is moved past (or to the left in FIG. 1A) of the cage slots. The rotary solenoid 70 may then be actuated such that the channels 64 of the trigger are rotated out of alignment with the cage slots. The trigger thus acts like a cam, pushing the latch balls above the outer wall 46 of the cage. In this position, just prior to locking the bearing member in the latched position, the second cylindrical surface of the bearing member provides a clearance between the latch balls and the bearing member. This clearance permits the latch balls to come under the influence of the magnetic flux field, causing the first ball 84, in particular, to move towards and against the first axially-extending side edge of the slot 90, i.e., the preferred starting location of the latch balls. The bearing member may now be manually released, locking the bearing member against the latch balls in the latched position (FIG. 1A).

To unlatch the ball latch mechanism, the rotary solenoid is again actuated, causing the trigger to turn until the channels and cage slots are aligned, wherein the latch balls radially retract into the channels, releasing the bearing member. During rotation of the trigger, the first ball will translate in a rolling motion circumferentially along the outer surface 62 of the trigger within the slot, significantly reducing the torque necessary to turn the trigger. During this rolling motion the first ball will also bear against the smooth, hard surface of the second ball, further reducing the torque required to turn the trigger.

To limit the axial movement of the bearing member upon unlatching, the frame 22 may be provided with an annular retaining wall 74 and the outer wall 26 of the bearing member may be provided with a circular retaining ridge 76. An elastomeric ring 78 may be placed adjacent to an inner edge 80 of the retaining wall to absorb the impact of the unlatched bearing member.

It should be appreciated from the foregoing description that the present invention employs the use of a magnetic flux circuit to attract individual spherical ball bearings used as locking elements, to a particular start position within a containment sleeve or cage, allowing a consistent and lower torque value requirement for rotation of the trigger to the unlatched position. The use of two or more balls in tandem alignment (more or less) within the cage slot also permits a consistent and lower torque value requirement for rotation of the trigger. Additionally, the use of a particular slot shape and configuration within the cage to position the balls in the tandem arrangement allows certain other desirable attributes such as stability of the locking position and a consistent and lower torque value requirement for rotation of the trigger.

It will, of course, be understood that modifications to the presently preferred embodiment will be apparent to those skilled in the art. For example, the bearing member may be placed inside the cage with the trigger placed outside the cage. Consequently, the scope of the present invention should not be limited by the particular embodiments discussed above, but should be defined only by the claims set forth below and equivalents thereof.

What is claimed is:

1. A ball latch mechanism, comprising:

a bearing member having a longitudinal axis and a bearing surface;

a trigger that is concentric to the bearing member, the trigger having a surface defining a notch;

an annular cage concentrically located between the bearing member and the surface of the trigger, the cage defining a slot therethrough, one of said bearing member and said cage being axially movable with respect to the other, and the trigger being rotatably disposed relative to the cage such that the trigger may be rotated from a latching position wherein the slot and the notch are not aligned to an unlatching position wherein the slot and the notch are aligned;

a first ball located in the slot in contacting relation with the surface of the trigger, the first ball being radially movable between a first position wherein the ball protrudes from the slot to interfere with the bearing surface of the bearing member when the trigger is in the latching position and a second position wherein the ball is retracted into the notch of the trigger when the trigger is in the unlatching position, permitting relative axial movement between the bearing member and the cage; and the slot being circumferentially elongated to permit the ball to move circumferentially relative to the cage such that, upon rotation of the trigger from the latching position to the unlatching position, the first ball rolls circumferentially along the surface within the slot.

2. The ball latch mechanism of claim 1, wherein the bearing member is outside the cage and the trigger is inside the cage.

3. The ball latch mechanism of claim 1, wherein the bearing member includes a first cylindrical surface and a second cylindrical surface and the bearing surface is a frustoconical surface separating the first and second cylindrical surfaces.

4. The ball latch mechanism of claim 1, wherein the trigger notch is an axially extending fluted channel at one end of the trigger.

5. The ball latch mechanism of claim 1, wherein the cage has a plurality of circumferentially elongated slots and the trigger has a corresponding plurality of notches.

6. The ball latch mechanism of claim 5, wherein the slots are located 90 degrees apart around the circumference of the cage and the notches are located 90 degrees apart around the circumference of the trigger.

7. The ball latch mechanism of claim 1, further comprising a second ball located in the cage slot, the cage slot being configured to securely retain the second ball in tandem alignment with the first ball such that the first ball bears against the second ball when it rolls from the first position to the second position.

8. The ball latch mechanism of claim 7, wherein the slot has a first portion for locating the first ball and a second portion having a semicircular edge for locating the second ball.

9. A ball latch mechanism, comprising:

a bearing member having a longitudinal axis and a bearing surface;

a trigger that is concentric to the bearing member, the trigger having a surface defining a notch;

an annular cage concentrically located between the bearing member and the surface of the trigger, the cage defining a slot therethrough with the slot having a first axially extending side edge, one of said bearing member and said cage being axially movable with respect to the other, and the trigger being rotatably disposed relative to the cage such that the trigger may be rotated from a latching position wherein the slot and the notch are not aligned to an unlatching position wherein the slot and the notch are aligned;

a first ball located in the slot in contacting relation with the surface of the trigger, the first ball being radially movable between a first position wherein the ball protrudes from the slot to interfere with the bearing surface of the bearing member when the trigger is in the latching position and a second position wherein the ball is retracted into the notch of the trigger when the trigger is in the unlatching position, permitting relative axial movement between the bearing member and the cage;

the slot being circumferentially elongated to permit the ball to move circumferentially relative to the cage such that, upon rotation of the trigger from the latching position to the unlatching position, the first ball rolls circumferentially along the surface within the slot; and a means for biasing the first ball toward the first axially extending side edge of the slot.

10. The ball latch mechanism of claim 9, wherein the biasing means includes a magnet.

11. The ball latch mechanism of claim 10, wherein the first ball is magnetic, the cage is nonmagnetic and the magnet is located in an axially extending bore of the cage adjacent the first axially extending side edge of the slot.

12. The ball latch mechanism of claim 9, further comprising a second ball located in the cage slot, the cage slot being configured to securely retain the second ball in tandem alignment with the first ball such that the first ball bears against the second ball when it rolls from the first position to the second position.

13. The ball latch mechanism of claim 12, further comprising a means for imparting an axial force on the bearing surface of the bearing member when the trigger is in the latching position, the axial force acting in a direction that urges the bearing surface into contact with the first ball protruding from the cage slot.

14. The ball latch mechanism of claim 13, wherein the slot has a first portion for locating the first ball and a second portion having a semicircular edge for locating the second ball, the first portion of the slot having the first axially extending side edge.

15. The ball latch mechanism of claim 14, wherein the first axially extending side edge of the first portion is offset circumferentially from the semicircular edge of the second portion such that when the first ball is in contact with the first axially extending side edge, it is past top dead center of the second ball.

16. The ball latch mechanism of claim 13, wherein the bearing member includes a clearance portion that may be radially aligned with the first ball when the bearing member and the cage are in a clearance position, the clearance portion having a diameter such that when the bearing member and the cage are in the clearance position and when the trigger is in the latched position, the first ball is free to move toward the first axially extending side edge of the cage slot in response to the biasing means.

* * * * *